US005993337A

United States Patent [19]

Janes et al.

[11] Patent Number: 5,993,337

[45] Date of Patent: Nov. 30, 1999

[54] MULTI-HOLE GROMMET FOR SPORTS RACQUETS

[75] Inventors: Richard Janes, Burlington Township, Burlington County, N.J.; Stephen J. Davis, Washington Crossing; William Harvie, III, Yardley, both of Pa.

[73] Assignee: Prince Sports Group, Inc., Bordentown, N.J.

[21] Appl. No.: 09/074,955

[22] Filed: May 8, 1998

[51] Int. Cl.[6] ..... A63B 49/00

[52] U.S. Cl. ..... 473/539

[58] Field of Search ..... 473/539, 540, 473/548

[56] References Cited

U.S. PATENT DOCUMENTS

| | | | |
|---|---|---|---|
| 2,542,661 | 2/1951 | Godfrey | 473/539 |
| 3,702,701 | 11/1972 | Vaughn et al. | 473/539 X |
| 4,891,175 | 1/1990 | Haines | 473/539 X |
| 5,029,859 | 7/1991 | Davis | 473/539 |
| 5,232,219 | 8/1993 | Tseng | 473/539 |
| 5,348,294 | 9/1994 | Shen | 473/539 |

*Primary Examiner*—Raleigh W. Chiu

*Attorney, Agent, or Firm*—White & Case

[57] ABSTRACT

A grommet member for use with a sports racquet comprises a grommet strip from which a plurality of hollow grommet pegs project for receiving racquet strings. The strip additionally includes at least grommet having at least two holes for receiving a pair of strings. Preferably, such grommet is either a multi-hole grommet or a triple hole grommet. The holes of the multi-hole grommet may be disposed on opposite sides of the grommet strip axis or alternately along the axis. In one embodiment, the multi-hole grommet includes a notch extending from its distal end partially towards said grommet strip to divide the end of the grommet into a pair of separate barrels, each barrel containing one of the two string holes Multi-hole grommets can be used to replace the shared grommet hole presently used on some sports racquets, in which the hole receives two racquet strings, i.e., either a cross-string and main string, or a main or cross-string and a tie-off string end. Triple hole grommets can receive both a main string and a cross-string and, in addition, receive a tie-off string end. The multi-hole grommet offers the same advantages as known shared grommet holes, in terms of reducing the number, and increasing the spacing, of the string holes in the corners of the frame, but overcomes the present drawbacks of the shared grommet hole in terms of difficulty of stringing and possible grommet failure.

15 Claims, 6 Drawing Sheets

MULTI-HOLE GROMMET FOR SPORTS RACQUETS

FIELD OF INVENTION

The present invention relates to sports racquets that utilize strings, for example, tennis racquets, squash racquets, badminton racquets, and racquetball racquets.

BACKGROUND OF THE INVENTION

The games of tennis, squash, badminton, and racquetball employ racquets having frames that define a generally oval head portion containing strings. The frames are typically made of a composite material such as "graphite", or a metal such as aluminum, and a plurality of string holes are drilled through the head portion to support the ends of the strings. In the case of racquet frames made of composite materials, it is customary to utilize one or more plastic grommet strips along the outer surface of the frame, which include hollow grommet pegs that extend through the string holes in the frame. The purpose of the grommet strips is to prevent direct contact between the strings and the edges of the string holes which, particularly at the points where the strings bend sharply to enter and leave the frame, would otherwise damage the strings.

FIG. 1 shows an example of a tennis racquet having a head portion 10, a pair of converging throat frame members 12, and a handle 14. A throat bridge 15 completes a stringing area which includes a plurality of main strings 16 and a plurality of cross strings 18, the latter being interwoven with the main strings 16. The ends of the strings 16, 18 are contained in grommets as described above, such that the string ends enter and leave the string bed 20 through the hollow barrels of the grommet pegs 22 whose ends project a short distance into the string bed.

Composite materials have a high strength-to-weight ratio, and can be molded into any desired cross-sectional shape, and thus today are the materials of choice for high performance sports racquets. A disadvantage of composite materials, however, is that racquet frames made of composite material can easily be broken by hitting an unyielding surface such as the ground. In order to reduce the incidence of breakage, it is customary in the tip region of the frame to provide the grommet strips with a pair of laterally extending wings to protect the outside surface of the frame. Such grommet strips are normally referred to as bumper strips.

In spite of the protection afforded by conventional bumper strips, frame breakage can still occur upon impact with the ground, particularly in the areas of the string holes where the frame tends to be weakened. Thus, there is always a concern, when designing a new racquet, over the number and placement of the string holes. Too many string holes cause a weakened frame which is more prone to breakage. Too few string holes can result in excess string breakage due to increased string movement and wear, as well as catastrophic string breakage due to having too few strings available to share the forces on the string bed produced by the impact of the ball.

Due to the elliptical shape of the head portion of racquets, in the corners of the head, the string holes for the main strings (longitudinal strings) are interspersed with the string holes of the cross-strings. If the string pattern is not carefully designed, one or more of the cross-string holes can end up being very close to the main string holes. Drilling two string holes in very close proximity is undesirable, because it weakens the frame. Thus, the string pattern needs to be designed to allow sufficient distance between string holes in the corner regions. Alternatively, rather than trying to design a string pattern to ensure adequate separation between the main and cross string holes in the corners, there have been attempts to design the string pattern such that the ends of a cross string and the ends of a main string share the same string holes, thereby reducing the number of holes that need to be drilled through the frame. An example of this is shown in FIG. 2.

FIG. 2 shows three cross strings 18*a*, 18*b*, 18*c*, and three main strings 16*a*, 16*b*, 16*c*, in the upper corner of a racquet having a stringing pattern similar to FIG. 1. The head portion 10 of the racquet frame is formed of a hollow tube of composite material such as to define an outer frame wall 24 and an inner frame wall 26. A plastic grommet strip 28 runs along the outwardly facing surface of the outer frame wall 24, in a stringing groove 30 customarily formed by the outer frame wall 24. The plastic grommet strip 28 includes a plurality of single string grommet pegs 22 and a double string grommet peg 32. As shown, each grommet peg 22, 32 extends through a pair of coaxial string holes formed, respectively, through the inner and outer frame walls 26, 24, and includes an end portion 22*a*, 32*a* that projects for a short distance into the stringing area.

As shown in FIG. 2, in a sports racquet, typically a continuous length of stringing forms the cross strings 18*a–c* and main strings 16*a–c*. The end of one string, e.g., 18*a*, exits the string bed and passes through the frame 10 through a grommet hole 32*a*. Thereafter, string 18*a* extends along the outer surface of the grommet strip 24 to the next grommet peg 22, whereupon it bends sharply to extend through that grommet peg and the frame 10 to re-enter the string bed. Upon re-entering the string bed, the string 18*a* interweaves with the main strings 16*a–c*. By successively passing through adjoining grommet peg holes and crossing the stringing area, the string bed is formed.

The single string grommet pegs 22 are all identical with one another, and are spaced along the grommet strip 24 so as to be aligned with the string holes in the frame, which in turn are located so as to produce the desired spacing between the main and cross strings. The double string grommet peg 32, which contains the shared hole 34, has the same overall configuration as grommet pegs 22, but is typically larger in diameter, in order to have a larger hole 34 for accommodating two strings.

Racquets are generally strung by threading and tensioning the main strings first, followed by the cross strings. Thus, in the example of FIG. 2, the string 16*c* would be inserted through the shared hole 34 first. Later on in the stringing process, the cross string 18*a* must be threaded through the same hole 34. Unfortunately, when a main string, e.g. 16*c*, passes through the grommet 32 and is tensioned, it hugs one wall as it enters the string hole 34, and then hugs the opposite wall as it leaves, crossing the hole 34 in the process. This causes a blockage of the grommet hole 34, and the second string, e.g., cross string 18*a*, cannot be threaded through the hole 34 without mechanically moving the main string 16*c* out of the way. This mechanical moving of the diagonally blocking string is carried out by passing a long pointed awl through the shared hole, thus forcing the first string 16*c* to the side.

If enough force is used, it is possible to maneuver the cross string 18*a* through the hole 34 and thereafter tension the string 18*a* without substantial interference from the main string 16*c*. However, the need to utilize a mechanical crushing force carries a high risk of damaging the string during the stringing process.

Another problem associated with shared holes is that, after the two strings pass through the grommet to enter the string bed, they travel in different directions relative to each other. Thus, as shown in FIG. 2, as the string 16*c* exits the grommet peg 32, it bends so as to extend parallel to the racquet axis, towards the bottom of the string area. String 18*a*, in contrast, bends so as to extend perpendicular to the racquet's axis, across the string bed. This tends to spread the lip 32*a* out in opposite directions, causing tension on the lip 32*a*. Grommet members tend to be made of nylon, and when this tension becomes too great, the strings 16*c*, 18*a* can tear the nylon lip 32*a*. Once the lip 32*a* tears, the string can come into contact the sharp edge of the frame string hole, causing breakage.

Shared string holes are desirable due to the fact that they reduce the overall number of holes drilled into the frame, and increase the distance between string holes in the corners of the racquet. It would be desirable to provide a grommet which provides the same advantages, but without the above-described drawbacks of the known shared grommet hole.

SUMMARY OF THE INVENTION

A grommet member for use with a sports racquet comprises a grommet strip from which a plurality of hollow grommet pegs project for receiving racquet strings. The strip additionally includes at least one grommet having at least two holes therethrough for receiving at least two strings. Preferably, such grommet either has two holes or is a triple hole grommet. The holes of the multi-hole grommet may be disposed on opposite sides of the grommet strip axis or, alternately, along the axis. In one embodiment, the multi-hole grommet includes a notch extending from its distal end partially towards said grommet strip to divide the end of the grommet into a pair of barrels, each barrel containing one of the two string holes.

A grommet member according to the invention can be used to replace known grommet strips having one or more shared grommet holes, by substituting multi-hole grommets for the shared grommet holes. The multi-hole grommet offers the same advantages as the known shared grommet holes, in terms of reducing the number, and increasing the spacing, of the string holes in the corners of the frame, but overcomes the present drawbacks of shared grommet holes in terms of difficulty of stringing, potential for string damage, and possible grommet failure.

For a better understanding of the invention, reference is made to the following detailed description of preferred embodiments, taken in conjunction with the drawings accompanying the application.

DETAILED DESCRIPTION OF PREFERRED EMBODIMENTS

Figure 3:
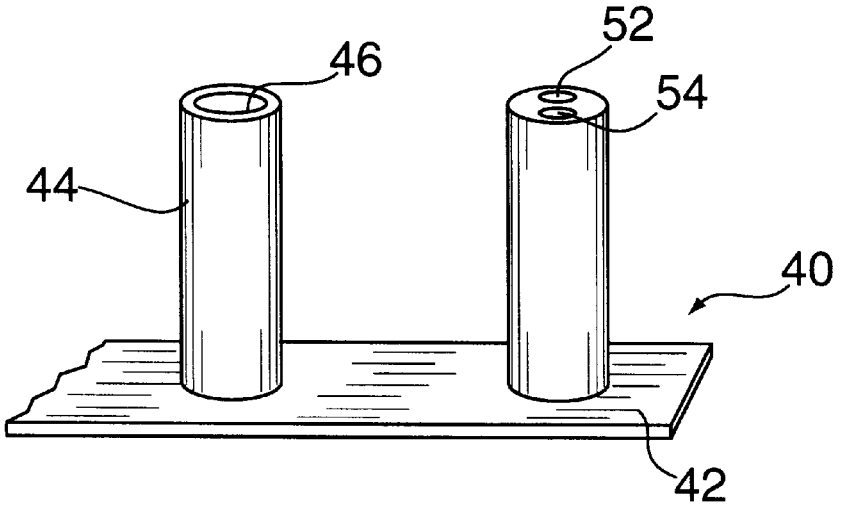
FIG. 3 is a perspective view of a portion of a grommet strip containing a multi-hole grommet according to the invention.
Figure 4:
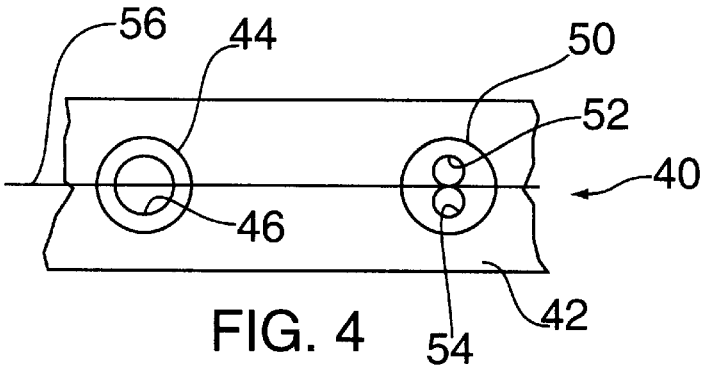
FIG. 4 is a plan view of the grommet strip shown in FIG. 4.

Referring to FIGS. 3–4, a grommet member 40 includes a grommet strip portion 42 which may be identical to the grommet strip portion of grommet members presently in use on sports racquets and may, if desired, include a pair of laterally projecting wings to cover over the frame surface in the tip of the racquet. Such grommet strip portions and bumper strips are conventional and thus need not be described further here.

Grommet strip portion 42 includes a plurality of conventional grommet pegs 44, one of which is shown for purposes of illustration. The grommet pegs 44 are round in cross-section, extend perpendicular to the grommet strip portion 42, and include a grommet hole 46 which passes through the grommet peg 44 and grommet strip portion 42, through which a racquet string can be directed. Grommet strip portion 42 also includes a multi-hole grommet 50, containing a pair of string holes 52, 54 which extend parallel to the longitudinal axis of the grommet 50 and similarly pass through the grommet 50 and grommet strip portion 42. As shown in FIG. 4, the grommet holes 52, 54 are positioned at right angles to the grommet strip axis 56, i.e., are disposed on opposite sides of such axis 56.

The multi-hole grommet 50 may have the same outside diameter as that of a conventional grommet 44, but preferably is given a slightly larger diameter, preferably in the range of 4–5 mm, and most preferably about 4 mm. Typically, a conventional grommet peg 44 has a diameter of 3.5 mm, and a grommet peg with a shared hole 34 has an outside diameter of 4 mm. The holes 52, 54 have, by way of example, a diameter of 1.4 mm, whereas hole 46 has a diameter of 1.6 mm. Typically, a shared hole 34 has a diameter of 2.6 mm.

The grommet member 40 may be formed in the same manner as a conventional grommet member, e.g., by molding the grommet strip integral, with the grommet pegs and multi-hole grommet or grommets, out of nylon or other suitable material.

Figure 2:
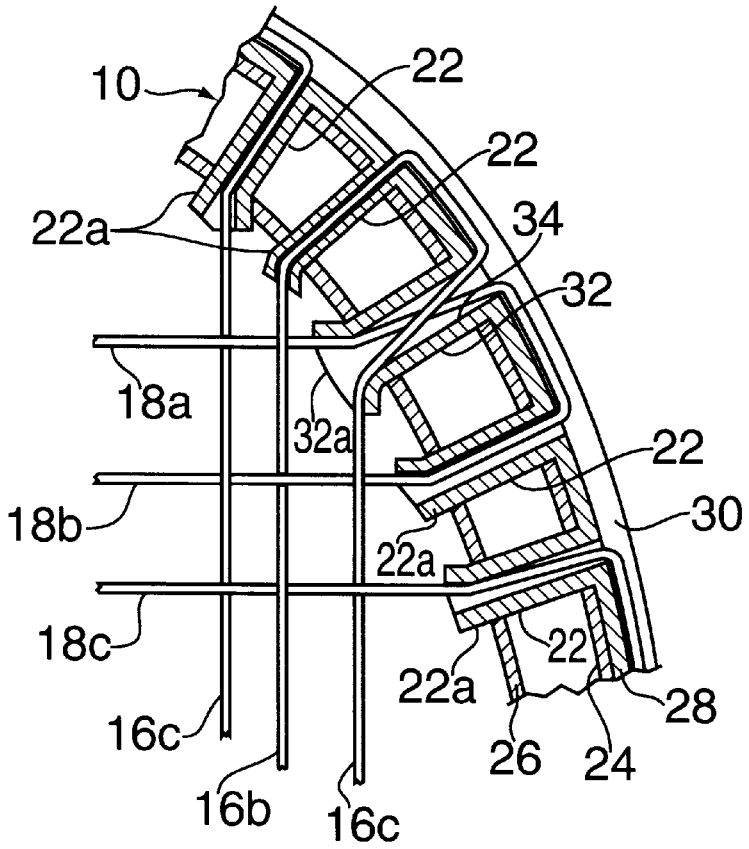
FIG. 2 Prior Art
FIG. 2 is a front sectional view of a corner portion of a conventional sports racquet such as that shown in FIG. 1.
Figure 5:
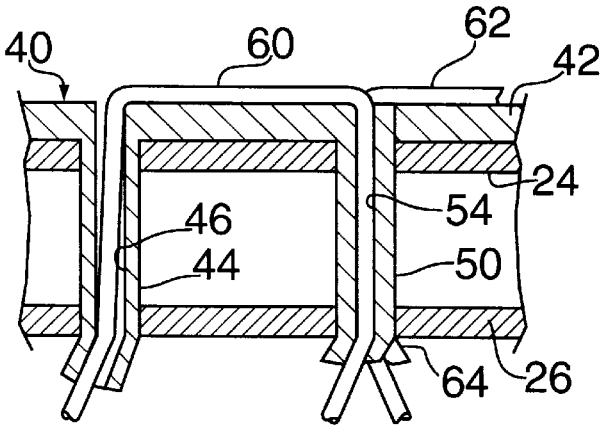
FIG. 5 is front sectional view of a portion of a racquet frame utilizing the grommet strip of FIGS. 3–4.

Referring to FIG. 5, grommet member 40 is positioned over the outer frame wall 24, in the same manner as a conventional grommet member, e.g. member 28 shown in FIG. 2, such that the grommet pegs 44 and multi-hole grommet 50 extend through string holes drilled through the outer and inner frame walls 24, 26. A first string 60, e.g., a cross string, passes through the conventional grommet peg 44, extends along the outside of the grommet strip portion 42, and then extends through one of the multi-hole grommet holes, e.g., hole 54. Another racquet string 62, e.g., a main string, extends along the outside of the grommet strip portion 42 and is directed down through the other multi-hole grommet string hole, e.g., 52. As shown in FIG. 5, as the two strings 60, 62 exit the multi-hole grommet 50, they diverge in different directions.

As is evident from the figures, whichever string is strung first, normally the main string 62, it will not interfere with the stringing of the second string 60. Moreover, the two strings 60, 62 when tensioned do not attempt to pull apart the same string hole. The force of the strings instead will cause the extending lip 64 of the grommet 50 to twist slightly. Moreover, the extending lip 64 is significantly stronger than a conventional grommet peg with a shared hole, because it has a thicker wall where the string deforms the grommet. For such reasons, the multi-hole grommet 50 will produce the advantages of a shared string hole, without the drawbacks of such known grommets.

Figure 1:
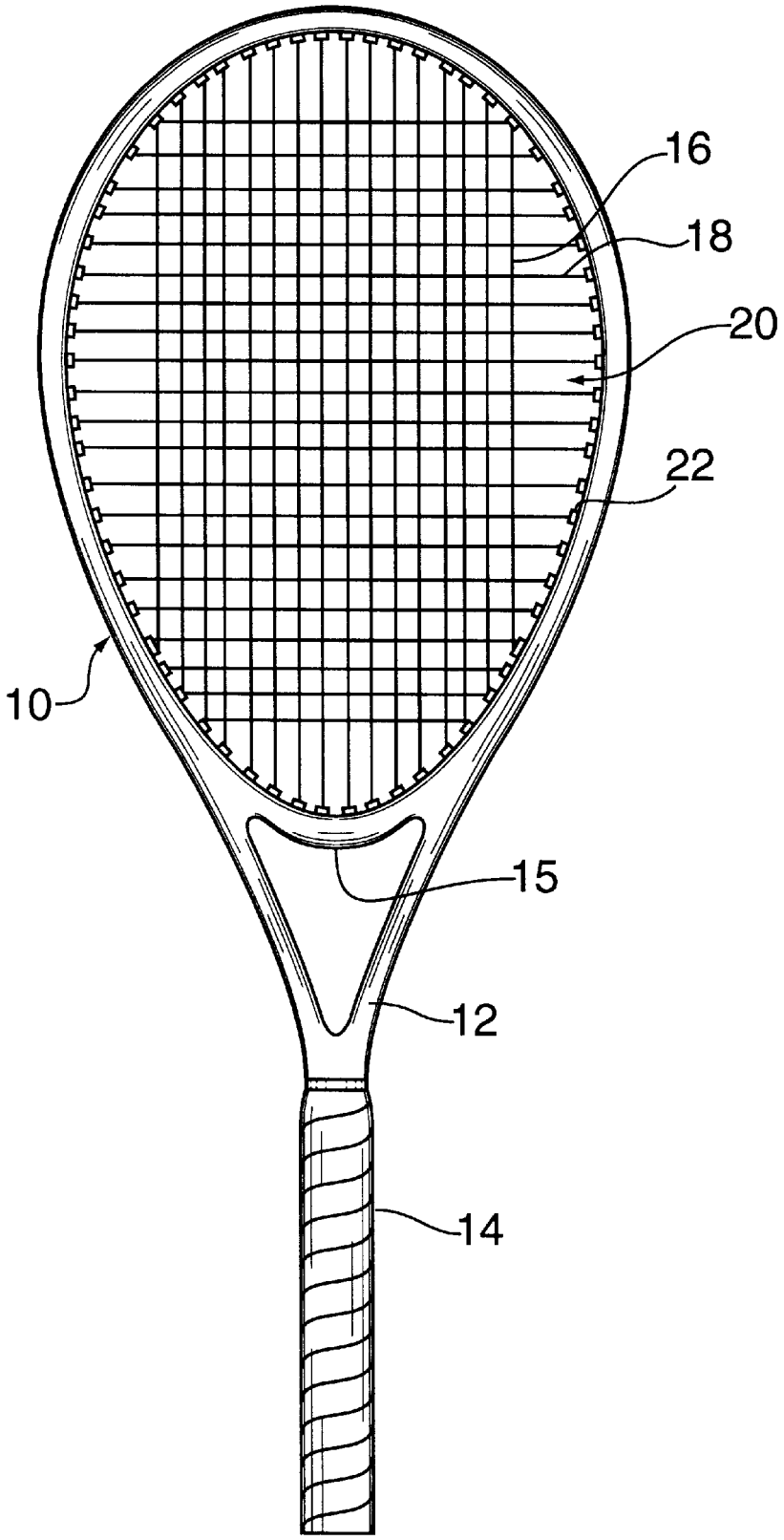
FIG. 1 is a front view of a tennis racquet which may employ the grommet system of the present invention.

Referring to FIG. 1, the number of string ends that can take advantage of the present invention will depend upon the shape of the racquet head and how the stringing pattern is designed. In the example shown in FIG. 1, a multi-hole grommet may be employed in the upper right and upper left corners of the head, and several multi-hole grommet pairs may be employed in the lower corners. In such a case, the conventional grommet strip (in the lower corners) and bumper strip (in the upper corners) would be modified to substitute a multi-hole grommet 50 for a conventional two string grommet peg 44 at such locations. For the remaining string holes, receiving only a single string, the grommet strip would continue to employ the conventional grommet pegs 44. In other known stringing patterns, additional main and cross string pairs in the racquet corners are located so that they may share, or could be repositioned slightly to share, a single multi-hole grommet. For stringing patterns where shared grommet holes can be utilized in such other locations, the conventional grommet and bumper strips would be modified to substitute multi-hole grommets at the appropriate locations.

Figure 6:
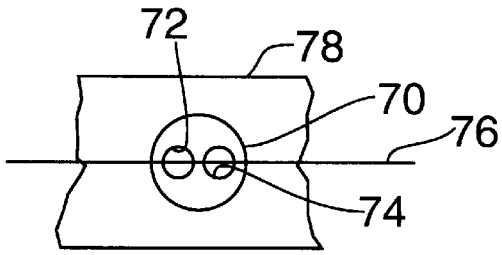
FIG. 6 is a plan view of an alternative embodiment of a multi-hole grommet according to the invention.
Figure 7:
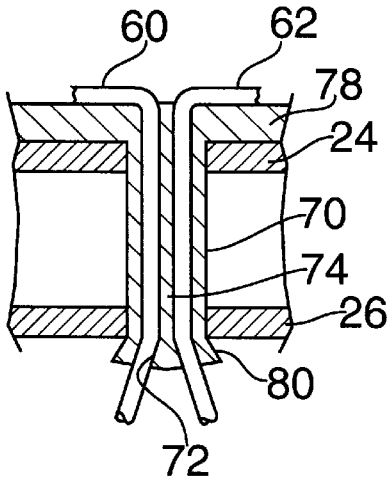
FIG. 7 is front sectional view of a portion of a racquet frame utilizing the grommet strip of FIGS. 6.

FIGS. 6–7 show a second embodiment of a multi-hole grommet 70. The grommet 70 is generally similar to the grommet 50 shown in FIGS. 3–5, except that the two grommet holes 72, 74 are aligned with the axis 76 of the grommet strip portion 78. As shown in FIG. 7, the grommet 70 is inserted through a pair of coaxial holes through the inner and outer frame wall s 26, 24, and includes a lip 80 that projects a short distance into the stringing area. Upon leaving the string hole in the inner frame wall 26, the strings 60 diverge in different directions. Although the strings tend to pull the lip 80 apart, the lip of the grommet 70 is substantially stronger than the lip of a conventional shared hole, because it has a higher average wall thickness than a conventional grommet. Although this embodiment is preferable when the strings 60, 62 do not cross one another as in the example shown in FIG. 7, it can be used when the strings cross as well. In the latter case, the strings 60, 62 would have to cross one another after leaving the grommet holes 72, 74. In order to avoid interference between the strings it may be desirable to rotate the positions of the holes 72, 74 slightly so as not to lie exactly along the axis 76.

Figure 8:
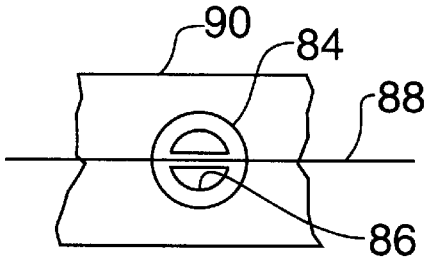
FIGS. 8 and 8*a* are plan views of two other embodiments of a multi-hole grommet according to the invention.

FIGS. 8 shows another embodiment of a multi-hole grommets 82, in which, rather than round grommet holes, the holes 84, 86 have a crescent, e.g., half moon, shape. In the embodiment shown, the flat sides of the holes are parallel to the axis 88 of the grommet strip 90, and strings would pass through the holes 84, 86 in a manner shown in FIG. 5. However, it is possible to rotate the holes 84, 86, by an angle, e.g., 90 degrees, in which case the strings would pass through the holes 84, 86 in the manner shown in FIG. 7.

Figure 8A:
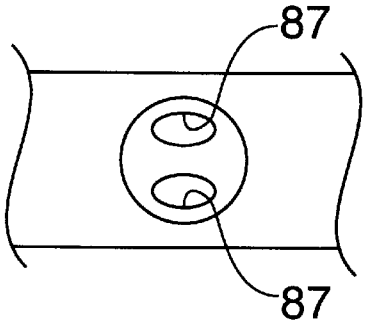

FIG. 8*a* shows a variation of the embodiment of FIG. 8 where, rather than crescent shape holes, the holes 87 are oval shaped. Other variations of hole shapes, e.g., oval, square, or rectangular, may be used as well. It may also be desirable to utilize slotted holes, in which the major axis is oriented perpendicular to the plane of the string bed, as disclosed in commonly owned U.S. patent application Ser. No. 08/772,411.

Figure 10:
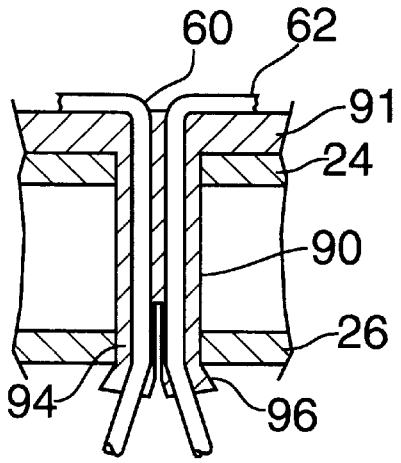
FIG. 10 is a side, sectional view of a portion of a racquet frame utilizing the grommet strip of FIG. 9.
Figure 9:
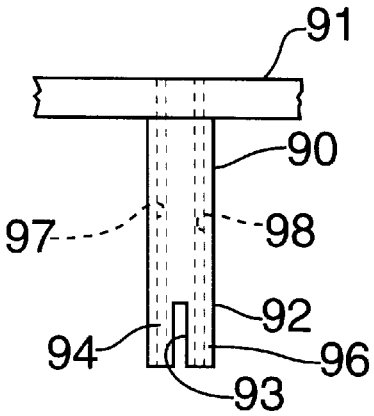
FIG. 9 is a side view of a section of a grommet strip containing another embodiment of a multi-hole grommet according to the invention.

FIGS. 9–10 show a variation of the multi-hole grommet shown in FIGS. 7–8. A multi-hole grommet 90 is integrally formed on a grommet strip 91 which contains other, conventional grommet pegs (not shown). The distal end 92 of the multi-hole grommet 90 includes a notch 93 dividing the end of the grommet into two separate barrels 94, 96, each barrel containing one of the grommet string holes 97, 98. In the embodiment of FIGS. 9–10, the holes 97, 98 are disposed along the axis of the strip 91, in the same manner as the holes 72, 74 of FIG. 6. As shown in FIG. 10, a pair of strings 60, 62 extend through the grommet 90 in the same manner as in FIG. 7 except that, upon exiting the string hole in the inner frame wall 26, the barrels 94, 96 can bend free of one another in the direction of string travel.

Figure 11:
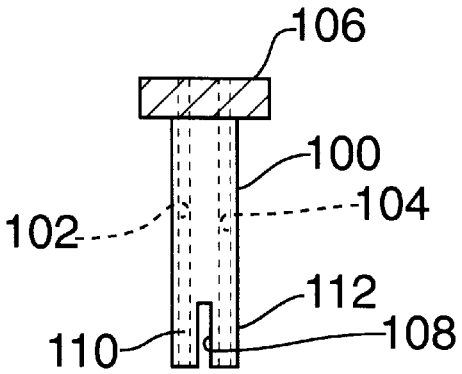
FIG. 11 is a front, sectional view of another embodiment of a multi-hole grommet according to the invention.

FIG. 11 shows a multi-hole grommet 100 which is similar to grommet 90, except that the grommet holes 102, 104 are disposed on opposite sides of the axis of the grommet strip 106, in the same manner as shown in FIG. 4. A notch 108 extends from the distal end of the grommet 90 partially towards the strip 106, to divide the end of the grommet into two separate barrels 110, 112, each barrel containing one of the string holes 102, 104. Strings would extend through the grommet 100 in the same manner as shown in FIG. 5 except that upon exiting the string hole in the inner frame wall 26, the barrels 110, 112 can bend free of one another in the direction of string travel.

Figure 12:
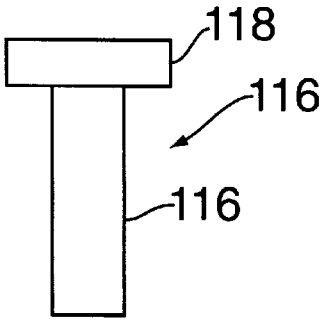
FIG. 12 is a front view of another embodiment of a multi-hole grommet according to the invention.

In the foregoing exemplary embodiments, the multi-hole grommet was part of an integral grommet strip containing conventional grommet pegs. The multi-hole grommets had a generally cylindrical body, and the grommet strip provided a shoulder at the upper end of the cylindrical body acting to seat the multi-hole grommet against the outer surface of the racquet frame. While it is preferred to utilize the multi-hole grommet as part of such a grommet strip, if desired individual multi-hole grommets 114 may be employed, as shown in FIG. 12. The grommet 114 has a cylindrical body 116, similar to the multi-hole grommets disclosed in connection with FIGS. 1–11. However, because there is no grommet strip to form an upper shoulder, an upper shoulder 118 is provided to seat the grommet in the string holes of the racquet frame. The grommets 114 may have any of the hole patterns, and if desired the notched ends, of the embodiments shown in FIGS. 1–11.

The shoulder 118 is preferably rectangular in cross-section, with a length greater than the width of the string groove, and a width corresponding to the string groove width. In this manner, the grommet 114 will be seated in the stringing groove with a predetermined orientation and, once clamped down by the string, will not twist. This ensures that the two holes formed in the multi-hole grommet will be oriented at the desired angle relative to the axis of the stringing groove, e.g., on opposite sides of the groove axis, as in the case of the holes 52, 54 of FIG. 4, or along the axis, as in the case of the holes 72, 74 of FIG. 6.

Figure 13:
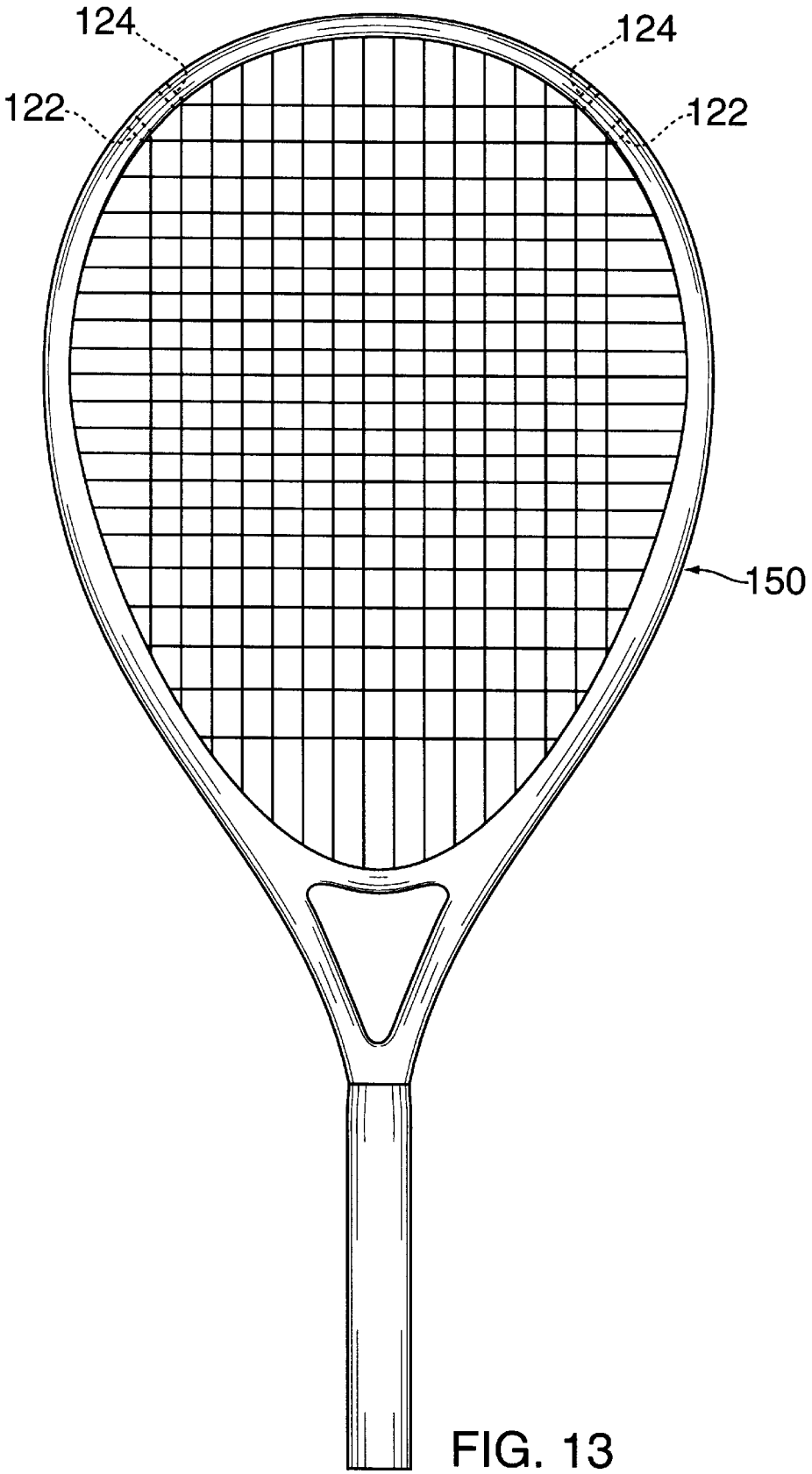
FIG. 13 is a front view of another tennis racquet, employing multi-hole and triple hole grommets.
Figure 14:
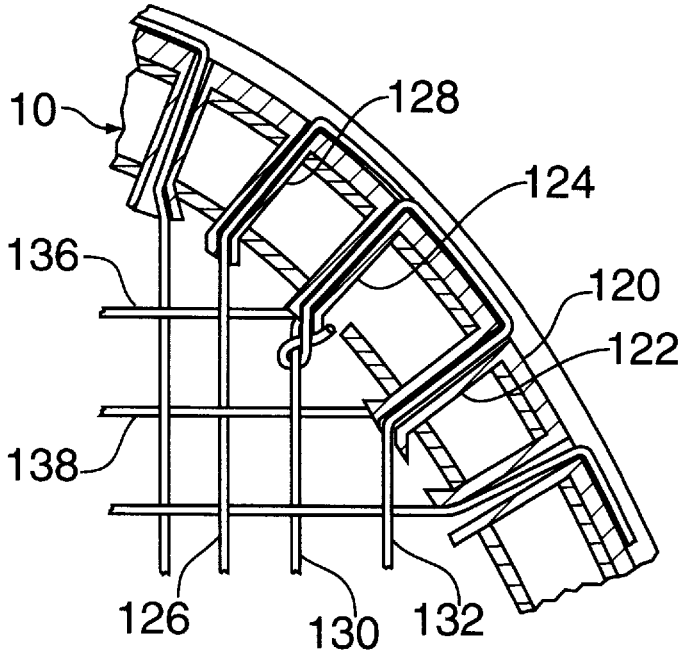
FIG. 14 is a front sectional view of an upper corner portion of the racquet of FIG. 13.
Figure 15:
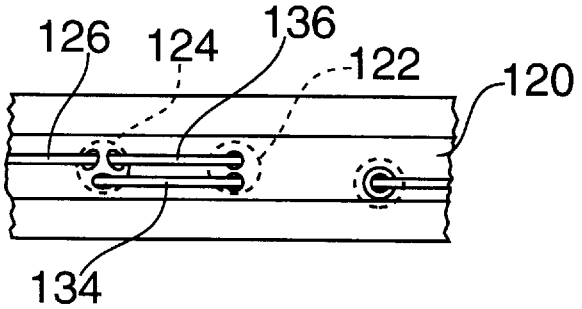
FIG. 15 is a top view of a portion of the grommet strip of FIG. 13, showing the multi-hole and triple hole grommets.
Figure 16:
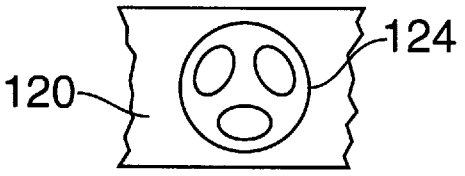
FIG. 16 is a top view, on an enlarged scale, of a portion of the grommet strip of FIG. 15, showing the triple hole grommet but without the strings for clarity.

FIG. 13 is a front view of another tennis racquet 150 in which the upper right and left hand corners each includes a multi-hole grommet 122 and a triple hole grommet 124, which are shown in greater detail in FIGS. 14–16. Referring to the latter figures, the grommet strip 120 includes both a multi-hole grommet 122, which may be the same as grommet 50 or 70, and a triple hole grommet 124. Main string 126 extends through single grommet 128 and about the outside of the frame to grommet 124, and then extends through one of the three holes in the grommet 124 as main string 130. Main string 132, which is the first main string, extends through one of the holes in the multi-hole grommet 122. As shown, the end 134 of the main string extends along the outside of the grommet strip 120, and through one of the holes of the triple grommet 124, where it is tied off around the string 130. The third hole of the triple grommet 124 is occupied by the upper cross string 136, which extends along the outside surface of the grommet strip 120, and through the multi-hole grommet 122 as cross-string 138.

Figure 17:
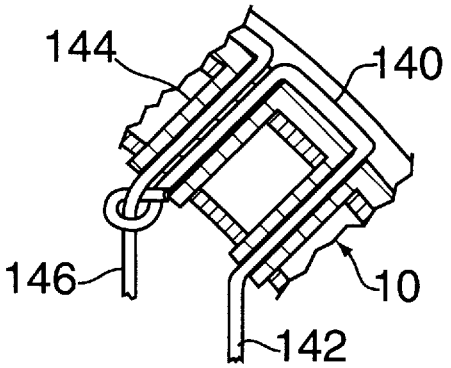
FIG. 17 is a front section view of a corner portion of another sports racquet, showing another embodiment of the invention.

FIG. 17 shows another embodiment in which the end 140 of the first main string 142 extends through one of the two holes in a multi-hole grommet 144 so as to be tied off around the next main string 146. Both in the case of FIGS. 14–16 and FIG. 17, the end 134, 140 of the first main string can be inserted through an adjacent string hole and tied off around an adjacent string. By providing a multi-hole or triple hole grommet, with a separate hole for the string end 134, 140, the string end can be inserted through the hole without the risk of damaging, or interfering with, the tie-off string.

The foregoing represents preferred embodiments of the invention. Variations and modifications will be apparent to persons skilled in the art, without departing from the inventive concepts disclosed herein. For example, while an example has been given of a multi-hole grommet in which the distal ends are separated into individual barrels, the distal ends of the triple hole grommet can also be formed either as three separate barrels, or as two separate barrels (one containing the cross string, and the other containing two holes for the main string and tie-off string). Also, while the examples show grommets which are circular in cross-section, grommets having other outside shapes, such as oval, square, or rectangular, may be employed. All such modifications and variations are intended to be within the skill of the art, as defined in the following claims.

We claim:

1. A multi-hole grommet for use with a sports racquet frame, said grommet comprising a generally elongated body, having an axis, for passing through a string hole formed in a racquet frame, a shoulder portion for engaging an outer surface of a racquet frame, and at least two axially oriented holes extending through said body for individually receiving racquet strings.

2. A multi-hole grommet according to claim 1, wherein said body has a distal end and includes a notch extending from said distal end partially towards said shoulder for dividing an end region of said grommet into at least two separate barrels, and wherein each barrel contains one of the holes.

3. A grommet member according to claim 1, wherein said shoulder has a width corresponding to the width of a conventional racquet stringing groove, and a length which is greater than said width such that, when said grommet member is inserted through a racquet string hole and seated in a string groove, it will be oriented at a predetermined angle relative to the string groove.

4. A grommet member, for use with a sports racquet frame, comprising a grommet strip having a surface and a plurality of hollow grommet pegs disposed axially along said strip and projecting from said surface; and further comprising at least one multi-hole grommet projecting from said surface and having at least two holes which extend therethrough and through said grommet strip for receiving a pair of strings.

5. A grommet member according to claim 4, wherein said multi-hole grommet has two holes, and wherein said grommet strip has an axis, and the holes of said multi-hole grommet are disposed on opposite sides of said axis.

6. A grommet strip according to claim 5, wherein the holes of said multi-hole grommet are at least generally circular in cross-section.

7. A grommet strip according to claim 5, wherein the holes of said multi-hole grommet are generally oval shaped in cross-section.

8. A grommet strip according to claim 5, wherein the holes of said multi-hole grommet are crescent shape in cross-section.

9. A grommet strip according to claim 5, wherein said multi-hole grommet has a distal end, and includes a notch extending from said distal end partially towards said grommet strip for dividing an end region of said multi-hole grommet into a pair of barrels, and wherein each barrel contains one of the two holes of said multi-hole grommet.

10. A grommet member according to claim 4, wherein said multi-hole grommet has two holes, wherein said grommet strip has an axis, and wherein the holes of said multi-hole grommet are disposed along said axis.

11. A grommet strip according to claim 10, wherein the holes of said multi-hole grommet are at least generally circular in cross-section.

12. A grommet strip according to claim 10, wherein the holes of said multi-hole grommet are generally oval shaped in cross-section.

13. A grommet strip according to claim 10, wherein the holes of said multi-hole grommet are crescent shape in cross-section.

14. A grommet strip according to claim 10, wherein said multi-hole grommet has a distal end, and includes a notch extending from said distal end partially towards said grommet strip for dividing an end region of said multi-hole grommet into a pair of barrels, and wherein each barrel contains one of the two holes of said multi-hole grommet.

15. A grommet strip according to claim 4, wherein said multi-hole grommet has a distal end, and includes a notch extending from said distal end partially towards said grommet strip for dividing an end region of said multi-hole grommet into at least two barrels, and wherein each barrel contains one of the holes of said multi-hole grommet.

* * * * *